United States Patent [19]

McKay

[11] 4,399,579

[45] Aug. 23, 1983

[54] LINT REMOVER

[75] Inventor: Nicholas D. McKay, Grand Blanc, Mich.

[73] Assignee: Helmac Products Corporation, Flint, Mich.

[21] Appl. No.: 290,780

[22] Filed: Aug. 6, 1981

[51] Int. Cl.[3] ..... A47L 25/00

[52] U.S. Cl. ..... 15/104 A

[58] Field of Search ..... 15/27, 104 A, 230.11; 242/552; 29/110.5, 116 R

[56] References Cited

U.S. PATENT DOCUMENTS

| | | | |
|---|---|---|---|
| 2,401,842 | 6/1946 | Slater | 15/104 |
| 2,592,969 | 4/1952 | Stachowiak | 15/104 A |
| 3,201,815 | 8/1965 | Selby | 15/104 A |
| 3,417,418 | 12/1968 | Riboud | 15/104 A |
| 3,421,170 | 1/1969 | Thomas, Jr. | 15/104 |
| 3,623,179 | 11/1971 | Roth | 15/104 A |

FOREIGN PATENT DOCUMENTS

| | | | |
|---|---|---|---|
| 470872 | 5/1969 | Switzerland | 15/104 A |
| 761756 | 11/1956 | United Kingdom | 15/230.11 |
| 1045986 | 10/1966 | United Kingdom | 15/230.11 |

*Primary Examiner*—Chris K. Moore

*Attorney, Agent, or Firm*—Miller, Morriss & Pappas

[57] ABSTRACT

A lint remover assembly comprising an adhesive tape roll sleeve-engaging hollow support cylinder container and an elongate handle member adapted for axially aligned end-to-end selective engagement with the open end of the cylinder container so as to selectively effect closure thereof to form a storage compartment therein. An adhesive tape roll sleeve assembly provided for selective axial slidable covering engagement with the hollow support cylinder container so as to be selectively rotatable thereon upon movable contact across a surface being cleaned.

7 Claims, 10 Drawing Figures

LINT REMOVER

This invention relates to a lint remover assembly comprising an adhesive tape roll sleeve-engaging hollow support cylinder container and an elongate handle member in axially aligned end-to-end selective engagement with the open end of the cylinder container so as to selectively effect closure thereof. An adhesive tape roll sleeve-engaging annular cylinder container stop flange is provided along the peripheral edge of the closed end of the cylinder container. An adhesive tape roll sleeve-engaging annular handle stop flange is provided on the support cylinder container-engaging end of the handle. An adhesive tape roll sleeve assembly is provided for axially slidable engagement with the outer surface of the hollow support cylinder container so as to be selectively rotatable thereon upon selective movable contact across a surface that is being cleaned. The adhesive tape roll sleeve assembly is retained on the support hollow support cylinder intermediate the cylinder container stop flange and the handle stop flange which cooperate to restrain the adhesive tape roll sleeve assembly against axial movement in relation to the hollow support cylinder while permitting selective rotative movement thereon. The adhesive tape roll assembly is selectively axially slidably removable from the hollow cylinder container upon selective disengagement of the handle member from the hollow cylinder container.

The outer surface of the hollow support cylinder container is selectively provided with at least two spaced-apart annular bearing ridges thereon which are adapted to slidably engage the inner surface of the adhesive tape roll sleeve assembly mounted on the hollow support cylinder container so as to facilitate relative selective rotative movement of the sleeve assembly with respect thereto.

In use, the hollow support cylinder container provides a convenient storage compartment for such items as panty hose, sewing equipment and other personal care items. The adhesive tape roll sleeve assembly is axially slidably positioned in covering engagement on the hollow cylinder container so that one end thereof is in abutting slidable contact with the cylinder stop flange. The elongate handle is then selectively fixedly attached to the hollow cylinder container so as to effect selective closure of the cylinder container storage compartment. Thus fixedly attached, the cylinder container does not rotate relative to the handle. With the handle thus positioned, the handle stop flange cooperates with cylinder container stop flange to restrain the adhesive tape roll assembly against relative axial movement with respect to the cylinder container but permitting selective rotatable movement thereon. The lint remover is utilized by holding it so that the outer adhesive surface of the adhesive tape roll sleeve assembly bears against the surface to be cleaned. The lint remover is selectively moved so as to cause the adhesive tape roll sleeve assembly to rotate upon the hollow cylinder container so as to roll over the surface being cleaned so that the adhesive tape engages and removes lint, dirt and other impurities from the surface being cleaned. In order to remove the used adhesive tape roll sleeve assembly from the cylinder container or to secure access to the storage compartment, the handle is selectively disengaged from the cylinder container.

None of the devices of the prior known art provide a lint remover which includes a convenient storage compartment for personal items. Further, none of the prior art lint remover devices teach a two-component lint remover assembly upon which an adhesive tape roll sleeve assembly can be easily installed for selective slidable rotative movement thereon and which can be easily removed therefrom for replacement when the adhesive tape supply is exhausted.

A need therefore existed for a lint remover assembly which is provided with a convenient storage compartment therein. A further need has existed for a simple two-component lint remover assembly which can rotatably support an adhesive tape roll sleeve assembly thereon without the need for ancillary complicated roller cylinder and/or adhesive tape roll sleeve-engaging end cap members.

It is therefore an object of this invention to provide a lint remover assembly having a convenient storage compartment therein.

Another object of this invention is to provide a simple two-component assembly which has no movable parts but which is adapted to slidably and rotatably receive an adhesive tape roll sleeve assembly thereon.

Other objects and advantages found in the construction of the invention will be apparent from a consideration of the following specification in connection with the appended claims and the accompanying drawings.

IN THE DRAWINGS

DESCRIPTION

Figure 1:
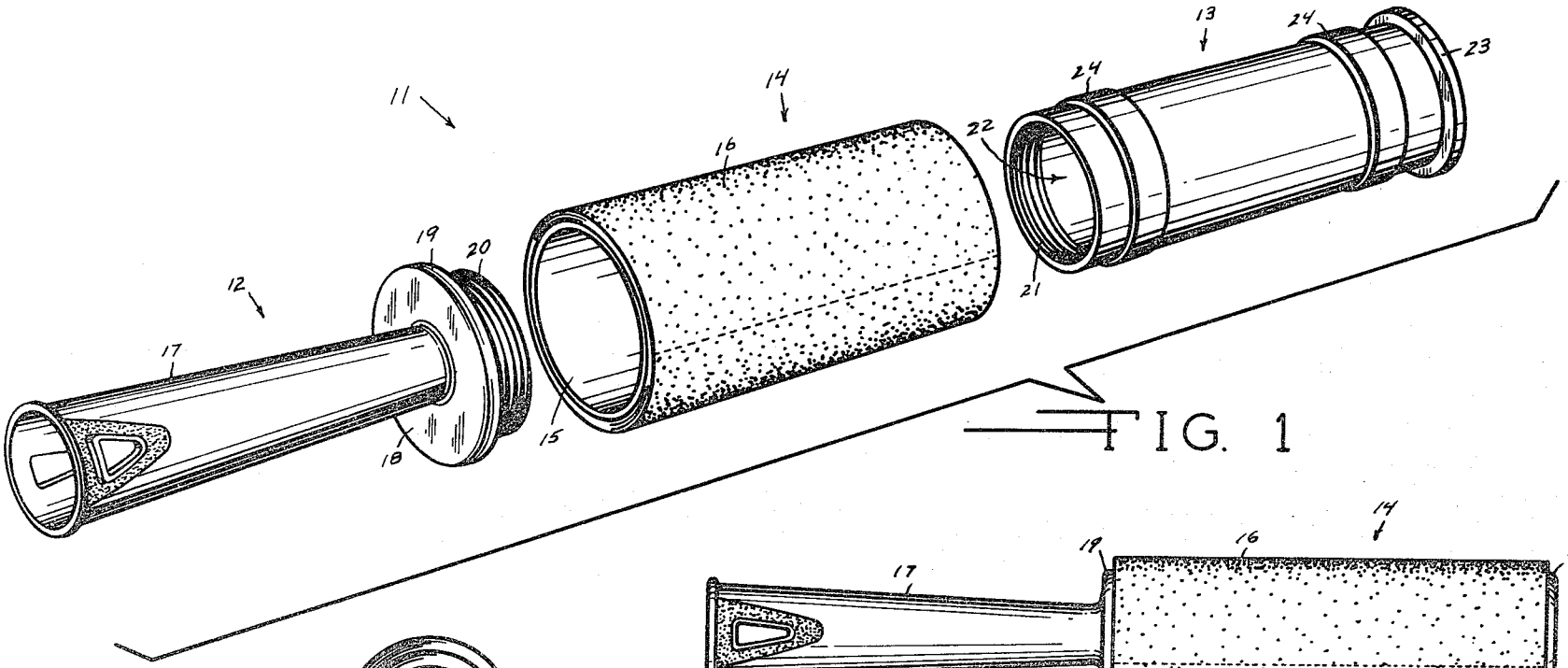
FIG. 1 is an exploded schematic perspective view of a lint remover showing the sleeve assembly support cylinder container, the handle adapted for threadable axial fixed engagement therewith and the adhesive tape roll sleeve assembly selectively utilized therewith.

As shown in FIG. 1, the lint remover assembly 11 is comprised of an elongate handle member 12 and a hollow adhesive tape roll sleeve support cylinder container 13. An adhesive tape roll sleeve assembly 14 is provided which includes a tubular sleeve 15 upon which a roll of lint remover adhesive tape 16 having an outwardly facing adhesive surface is provided. The sleeve 15 can be fabricated from plastic, cardboard or any other desired material.

The preferred embodiment of the handle member 12 is integrally molded from plastic or other desired material and consists of a hollow conically tapered handle portion 17 which is integrally axially connected at one end thereof to a transversely oriented circular disc closure member 18 provided with an adhesive tape roll sleeve-engaging annular handle stop flange 19 thereon. A threaded closure plug extension 20 is provided on the handle member 12 which is adapted for selective fixed threaded closure engagement with the threaded open end 21 of the support cylinder container 13.

The hollow support cylinder container 13 is also integrally molded from plastic or other desired material and is closed at one end so as to form a storage compartment 22 therein. An adhesive tape roll sleeve-engaging cylinder container annular stop flange 23 is provided along the peripheral edge of the closed end of the cylinder container 13. The outer surface of the hollow support cylinder container 13 can be selectively provided with at least two spaced-apart annular bearing ridges 24 which are adapted to selectively slidably engage the inner surface of the sleeve 15 selectively mounted on the hollow support cylinder container 13. However, it is considered to be within the scope of the invention that the inner surface of the sleeve 15 can slidably directly matingly engage the outer surface of the cylinder container 13 so as to be selectively rotatable thereon.

As shown in FIGS. 6 through 10, another embodiment of the invention is provided having an elongate flat handle 25 which is integrally molded with the circular closure disc member 18. In all other aspects, the modified lint remover shown in FIGS. 6 through 10 operates in the same manner as the previously described preferred embodiment of the invention shown in FIGS. 1 through 5.

During manufacture, the adhesive tape 16 is rolled onto the sleeve 15 with the adhesive surface facing outwardly and consists of perforated sections that can be selectively detached as the adhesive surface is filled with lint. In a manner well known in the prior art, the adhesive surface is rollably moved over the surface being cleaned and the lint particles, dirt and other impurities adhere thereto. When the outer adhesive tape surface becomes full of lint, the used section thereof is torn off so as to expose a new adhesive tape surface therebelow. This is repeated until the tape is completely used. The used adhesive tape roll sleeve assembly 14 is then axially slidably removed from the cylinder container 13 and a new replacement adhesive tape roll sleeve assembly 14 is placed thereon.

Figure 2:
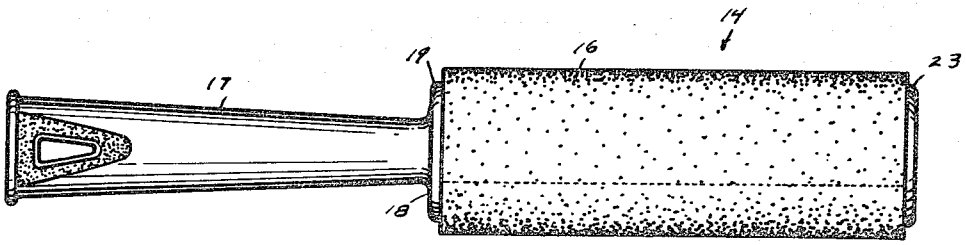
FIG. 2 is a side elevational assembled view thereof.
Figure 3:
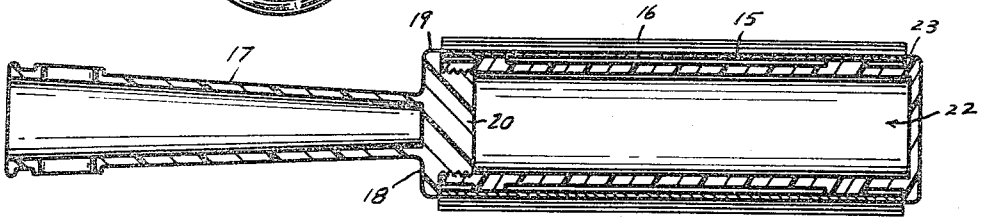
FIG. 3 is a schematic full cross-sectional view thereof.
Figure 4:
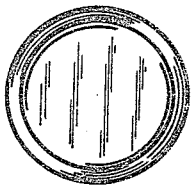
FIG. 4 is a right end view thereof.
Figure 5:
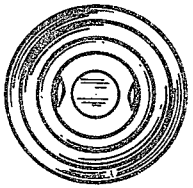
FIG. 5 is a left end view thereof.
Figures 6, 7, 8, 9, 10:
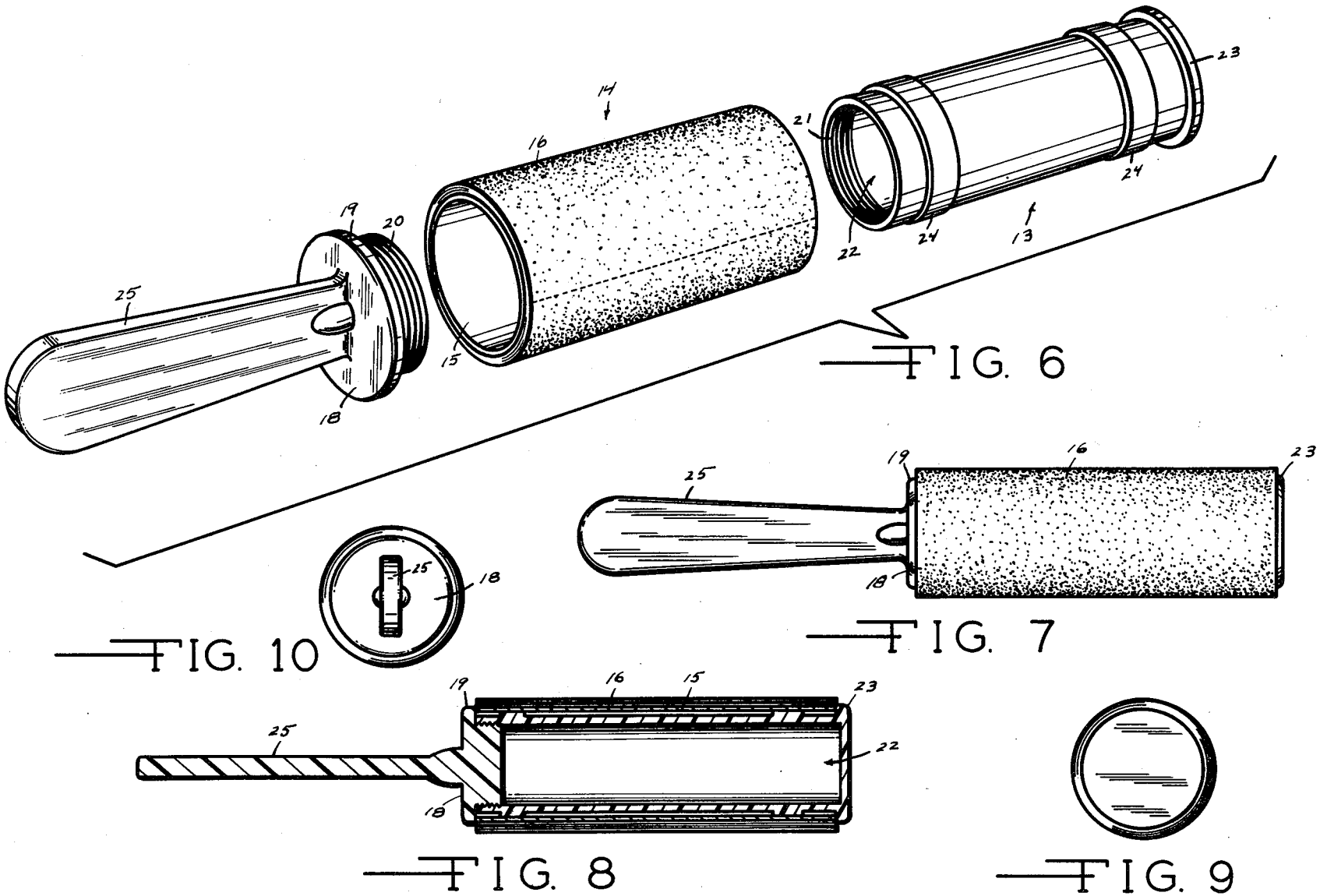
FIG. 6 is an exploded schematic perspective view of a modified lint remover showing the elongate flat handle member.
FIG. 7 is a side elevational view of the modified lint remover shown in FIG. 6.
FIG. 8 is a schematic full cross-sectional view of the modified lint remover shown in FIG. 6.
FIG. 9 is a right end view of the modified lint remover as shown in FIG. 7.
FIG. 10 is a left end view of the modified lint remover shown in FIG. 7.

In operation, the adhesive tape roll sleeve assembly 14 is slidably moved axially into mating engagement on the cylinder container 13 so that one end of the sleeve 15 is in abutting movable contact with the cylinder container stop flange 23 as shown in FIGS. 2, 3 and 8. The handle member 12 is then threadably mounted onto the open end of the cylinder container 13 so as to effect closure of the storage compartment 22 as shown in FIGS. 3 and 8. In its operative use position, the handle member 12 is fixedly connected to the cylinder container 13 and there is no relative movement therebetween. Although the preferred embodiment of the invention shows a threaded engagement between the handle member 12 and the cylinder container 13, it is within the scope of the invention that any other type of snap-lock means that are known in the prior art can be utilized to selectively fixedly attach the handle 12 to the cylinder container 13.

In summary, a lint remover assembly is provided which comprises an adhesive tape roll sleeve-engaging hollow cylinder container being open at one end thereof so as to define a storage compartment therein. An elongate handle member is provided in axially aligned end-to-end selective fixed engagement with the open end of the cylinder container so as to selectively effect closure of the storage compartment. An adhesive tape roll sleeve assembly is provided for selective rotatably slidable covering engagement with the cylinder container. An adhesive tape roll sleeve-engaging annular cylinder container stop flange is provided along the peripheral edge of the closed end of the cylinder container and an adhesive tape roll sleeve-engaging annular handle stop flange is provided on the support cylinder container-engaging end of the handle member. The handle stop flange is in spaced-apart axially aligned register with the cylinder container stop flange. The handle stop flange and cylinder stop flange are adapted to slidably retain the sleeve member therebetween so as to restrain the adhesive tape roll sleeve assembly against relative axial movement on the cylinder container while permitting selective rotative movement of the adhesive tape roll sleeve assembly on the cylinder container. At least two spaced-apart annular bearing ridges are provided on the outer surface of the cylinder container which are adapted to facilitate rotative movement of the adhesive tape roll sleeve assembly on the cylinder container.

The adhesive tape roll sleeve assembly includes a hollow sleeve member which is provided with a lint removing adhesive tape roll positioned thereon.

In summary, a simple, easy to operate, highly utilitarian lint remover assembly is provided which defines a convenient storage compartment therein.

Various other modifications of the invention may be made without departing from the principle thereof. Each of the modifications is to be considered as included in the hereinafter appended claims, unless these claims by their language expressly provide otherwise.

I claim:

1. In a lint remover assembly, the combination comprising:

an adhesive taper roll sleeve-engaging hollow cylinder container being open at one end thereof, said cylinder container defining a storage compartment therein; and an elongate handle member in axially aligned end-to-end selectively fixed engagement with said open end of said cylinder container so as to selectively effect closure of said storage compartment.

2. In the lint remover assembly of claim 1 wherein an adhesive tape roll sleeve assembly is provided for selective rotatably slidable covering engagement with said cylinder container.

3. In the lint remover assembly of claim 2 wherein said adhesive tape roll sleeve assembly includes a hollow sleeve member, said hollow sleeve member provided with a lint removing adhesive tape roll positioned thereon.

4. In the lint remover assembly of claim 3 wherein an adhesive tape roll sleeve-engaging annular cylinder container stop flange is provided along the peripheral edge of the closed end of said cylinder container and an adhesive tape roll sleeve-engaging annular handle stop flange is provided on the support cylinder container-engaging end of said handle member, said handle stop flange being in spaced-apart axially aligned register with said cylinder container stop flange, said handle stop flange and said cylinder container stop flange adapted to slidably retain the sleeve member therebetween so as to restrain said adhesive tape roll assembly against relative axial movement on said cylinder container while permitting selective rotative movement of said adhesive taper roll sleeve assembly on said cylinder container.

5. In the lint remover assembly of claim 1 wherein at least two spaced-apart annular bearing ridges are provided on the outer surface of said cylinder container, said spaced-apart bearing ridges adapted to facilitate rotative movement of said adhesive tape roll sleeve assembly on said cylinder container.

6. In the lint remover assembly of claim 1 wherein said handle member comprises an elongate hollow conical handle member.

7. In the lint remover assembly of claim 1 wherein said handle member comprises an elongate flat handle member.

* * * * *